US007605758B2

(12) United States Patent
Lazar

(10) Patent No.: US 7,605,758 B2
(45) **Date of Patent: *Oct. 20, 2009**

(54) HIGHLY ISOLATED CIRCULAR POLARIZED ANTENNA

(75) Inventor: George Lazar, Kiriat Ono (IL)

(73) Assignee: Go Net Systems Ltd., Tel Aviv (IL)

( * ) Notice: Subject to any disclaimer, the term of this patent is extended or adjusted under 35 U.S.C. 154(b) by 42 days.

This patent is subject to a terminal disclaimer.

(21) Appl. No.: 11/128,208

(22) Filed: May 13, 2005

(65) Prior Publication Data

US 2006/0256013 A1 Nov. 16, 2006

(51) Int. Cl.
*H01Q 1/38* (2006.01)

(52) U.S. Cl. ..... 343/700 MS

(58) Field of Classification Search ..... 343/700 MS, 343/872

See application file for complete search history.

(56) References Cited

U.S. PATENT DOCUMENTS

| | | | | |
|---|---|---|---|---|
| 4,866,451 | A | 9/1989 | Chen | |
| 5,231,406 | A * | 7/1993 | Sreenivas | 343/700 MS |
| 6,326,923 | B2 | 12/2001 | Shigihara | |
| 6,518,935 | B2 * | 2/2003 | Louzir et al. | 343/853 |
| 6,549,168 | B1 * | 4/2003 | Ryken et al. | 343/700 MS |
| 6,621,456 | B2 * | 9/2003 | Ryken et al. | 343/705 |
| 6,756,942 | B2 * | 6/2004 | Heyde | 343/700 MS |
| 6,801,167 | B2 * | 10/2004 | Shibata | 343/700 MS |
| 6,919,844 | B1 * | 7/2005 | Ryken et al. | 343/700 MS |
| 2002/0163468 | A1 * | 11/2002 | Anderson | 343/700 MS |
| 2004/0189532 | A1 | 9/2004 | Nakano et al. | |
| 2006/0001584 | A1 * | 1/2006 | Durso et al. | 343/718 |
| 2006/0044191 | A1 * | 3/2006 | Harihara | 343/700 MS |
| 2006/0071856 | A1 * | 4/2006 | Shinkai et al. | 343/700 MS |
| 2006/0258315 | A1 * | 11/2006 | Fein et al. | 455/295 |

FOREIGN PATENT DOCUMENTS

| | | | |
|---|---|---|---|
| JP | 06232627 A * | 8/1994 | |
| WO | WO9908337 A1 | 2/1999 | |

* cited by examiner

*Primary Examiner*—Tan Ho
(74) *Attorney, Agent, or Firm*—Vladimir Sherman; Professional Patent Solutions

(57) ABSTRACT

An antenna featuring a pair of radiating elements. Each pair of radiating element is fed from the same input. Each radiating element is a stacked antenna made of feeding patch and radiating patch featuring cross recessed corners. Moreover, the corners of a radiating patch and the corners of its feeding patch are cut in opposite directions. The use of recessed corner patches result in improved cross-polarization. Improved cross-polarization leads to better isolation between radiating elements of an array antenna and to an antenna featuring improved isolation from its surroundings.

7 Claims, 5 Drawing Sheets

HIGHLY ISOLATED CIRCULAR POLARIZED ANTENNA

FIELD AND BACKGROUND OF THE INVENTION

The present invention relate to antennas and, more particularly, to highly isolated, circular, polarized smart antennas featuring complementary cross recessed corners patches. The present invention is primarily directed to applications of smart antennas featuring simultaneously transmitting antennas and receiving antennas, however, the present invention can clearly be directed to applications of multiple, independent, closely mounted antennas, in a variety of fields such as wireless network, cellular, security, military, surveillance and medical applications.

Basic principles and details relating to antennas needed for properly understanding the present invention are provided herein. Complete theoretical descriptions, details, explanations, examples, and applications of these and related subjects and phenomena are readily available in standard references in the fields of telecommunication, physics, and materials science.

Previous art devices such as noise cancellation, interference cancellation, and regular channel filters are expensive solutions for leakages between adjacent channels.

A significant general limitation of currently available interference cancellation devices, is that they are using a small fraction of the transmitted signal with a phase correction to cancel the leakages between the adjacent channels. Therefore, interference cancellation is an expensive and sensitive solution because of the need to control the phase and amplitude of the correcting signal by means of vector modulators or phase shifters, which are sensitive and expensive components. In addition, the implementation of interference cancellation is problematic because of the parasitic capacitors which require evaluation and compensation.

Recently, several devices, based on circular polarized antennas have been disclosed. In these disclosures there is no reference to the novel embodiment of the present invention.

There is substantial prior art regarding circular polarized antennas. However, none of the following indicated prior art refers to highly isolated, circular polarized, multiple, independent, closely mounted antennas, or includes the important feature of recessed corner patches.

Prior art includes various teachings of using recessed corners. In PCT International Patent Application Publication No. WO/9908337A1, issued to Hansen Per Steinar et al., there is disclosed a method of using a microwave antenna comprises a dielectric substrate with an emitter element and a feed line to the emitter element, and on the substrate underside there is a ground plane for the feed line. A separate ground plane for the emitter element is arranged at a larger distance from the substrate, and the two ground planes are interconnected electrically. The feed line ground plane is shaped with a tuning section extending somewhat in underneath the emitter element, and the tuning section is connected to the rest of the feed line ground plane via a transition section. However, there is no description or suggestion for using more than one recessed corner patch. Moreover, Hansen Per Steinar et al. provides no description or suggestion relating to determining and/or using two complementary recessed corners patches.

In U.S. Patent Application No. 20040189532A1, issued to Nakano Hisamatsu et al., there is disclosed an antenna apparatus comprises a dielectric substrate, a radiation element buried in the dielectric substrate, and a feeding lead connected to the radiation element and extracted outward from the dielectric substrate. The dielectric substrate is covered with a conductor cover except an exposed portion left on a front surface thereof. The conductor cover comprises a side wall portion extending in a thickness direction of the radiation element and covering all side surfaces of the dielectric substrate, and a hood portion extending from an upper edge of the side wall portion and covers a part of the front surface of the dielectric substrate. The hood portion has a trapezoidal or a rectangular shape. Here too, there is no description or suggestion relating to using more than one recessed corner patch. Moreover, Nakano Hisamatsu et al. provides no description or suggestion relating to determining and/or using two complementary recessed corners patches.

In U.S. Pat. No. 6,326,923, issued to Shigihara Makoto, there is disclosed a miniaturized circular polarized microstrip antenna that employs a dielectric substrate having a large relative dielectric constant so that a desired resonance frequency and a desired axis ratio are obtained. In a circular polarized wave microstrip antenna having a nearly square dielectric substrate with a nearly square patch electrode formed on one surface thereof, and a ground electrode formed on almost the whole of another surface thereof, triangular first notches and serving as retraction-separation elements are respectively formed 135 and 315 degrees with respect to a direction toward a feeding point from the center of the patch electrode, which is defined as 0, and within the first notch, a first adjustment electrode extending outwardly from an edge of the patch electrode is formed. On the other hand, a triangular second notch is formed 45 degrees with respect to a direction toward the feeding point from the center of the patch electrode, which is defined as 0, and within the second notch, a second adjustment electrode extending outwardly from an edge of the patch electrode is formed. Here too, there is no description or suggestion relating to using more than one recessed corner patch. Moreover, Shigihara Makoto provides no description or suggestion relating to determining and/or using two complementary recessed corners patches.

In U.S. Pat. No. 4,866,451, issued to Chen Chun-Hong, there is disclosed a circular polarization technique and a microstrip array antenna implementing this technique. Using four microstrip radiating elements with proper phasing of the excitation in a 2×2 array configuration, the technique averages out the cross-polarized component of the radiation, generating circular polarization of high purity. The technique is broadband and capable of dual-polarized operation. The resultant 2×2 array can be used either independently as a circular polarization radiator or as the building subarray for a larger array. Here too, there is no description or suggestion relating to using more than one recessed corner patch. Moreover, Chen Chun-Hong provides no description or suggestion relating to determining and/or using two complementary recessed corners patches.

To date, the inventor is unaware of prior art teaching of highly isolated, circular, polarized smart antennas featuring recessed corner patches.

There is thus a need for, and it would be highly advantageous to have a highly isolated, circular, polarized smart antenna featuring recessed corner patches. The present invention is primarily directed to applications of smart antennas featuring simultaneously transmitting antennas and receiving antennas, however, the present invention can clearly be directed to applications of multiple, independent, closely mounted antennas, in a variety of fields such as wireless network, cellular, security, military, surveillance and medical applications.

It is also desirable, and it would be highly advantageous to have an inexpensive smart antenna, which features high performance by providing a filter and the recessed corner patches.

SUMMARY OF THE INVENTION

The present invention relates to antennas and, more particularly, to highly isolated, circular, polarized smart antennas featuring complementary cross recessed corners patches. The present invention is primarily directed to applications of smart antennas featuring simultaneously transmitting antennas and receiving antennas, however, the present invention can clearly be directed to applications of multiple, independent, closely mounted antennas, in a variety of fields such as wireless network, cellular, security, military, surveillance and medical applications.

The present invention successfully addresses shortcomings and limitations of presently known antennas, by being simpler, more rapid, and therefore, more cost effective, than currently used techniques for antenna isolation. The antenna of the present invention is readily implemented using materials. Moreover, the antenna of the present invention is generally applicable as a single antenna, or, as a smart antenna Thus, according to the present invention, there is provided a highly isolated, circular, polarized antennas featuring (a) a feeding patch having cross recessed corners, (b) a radiating patch having complementary cross recessed corners.

According to further features in preferred embodiments of the present invention, the circular polarized antenna further includes at least two radiating elements fed from the same input.

According to still further features in the described preferred embodiments, the feeding patch and the radiating patch are sandwiching a dielectric material.

According to still further features in the described preferred embodiments, the characteristics of the circular polarized antenna are controlled by setting different values and combinations to parameters further includes: (a) size of the cross-recessed corners, (b) distance between the two radiating elements fed from the same input, (c) distance between the radiating patch and the feeding patch, (d) thickness and type of a sandwiched dielectric material located between the feeding patch and the radiating patch.

According to still further features in the described preferred embodiments, the circular polarized antenna further includes low sensitivity to the shape of a Radome covering it.

According to still further features in the described preferred embodiments, the radiating elements are polarization shifted.

According to still further features in the described preferred embodiments, the circular polarized antenna further includes a filter.

According to still further features in the described preferred embodiments, the circular polarized antenna is an array antenna According to another aspect of the present invention, there is provided a circular polarized stacked array antenna featuring: (a) feeding patches having cross recessed corners, (b) radiating patches having cross recessed corners, (c) at least one sandwiched cross-recessed corner patch, wherein the patches are arranged in such a way that every two following stacked patches are cut in the complementary corners.

According to still further features in the described preferred embodiments, the circular polarized stacked array antenna further includes a filter.

BRIEF DESCRIPTION OF THE DRAWINGS

The present invention is herein described, by way of example only, with reference to the accompanying drawings. With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the present invention. In this regard, no attempt is made to show structural details of the present invention in more detail than is necessary for a fundamental understanding of the invention, the description taken with the drawings making apparent to those skilled in the art how the several forms of the invention may be embodied in practice. Identical structures, elements or parts which appear in more than one figure are preferably labeled with a same or similar number in all the figures in which they appear. In the drawings.

DESCRIPTION OF THE PREFERRED EMBODIMENTS

Figure 1:
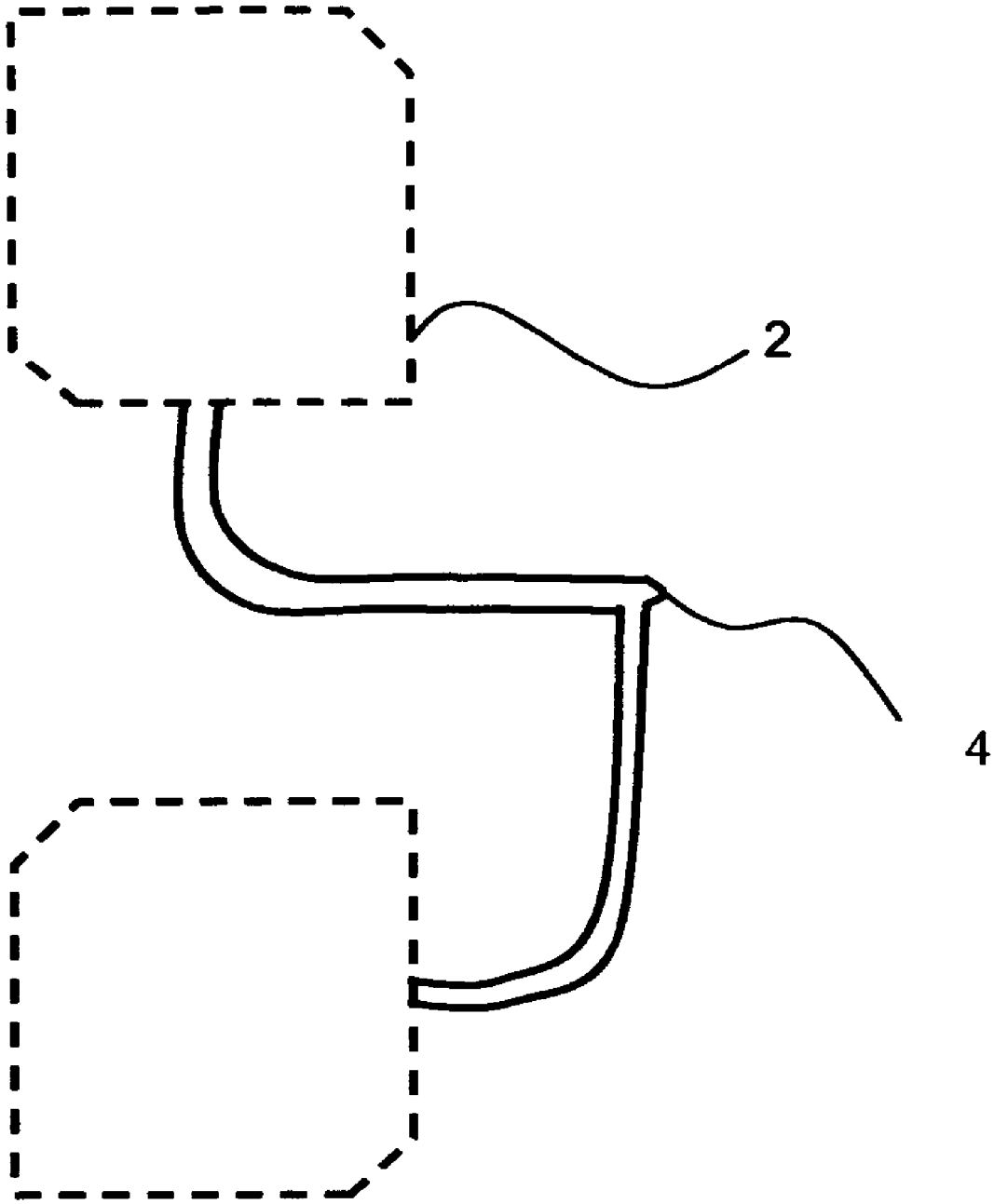
FIG. 1 is an illustration of a preferred embodiment of the circular polarized antennas with shifted polarization feeds, in accordance with the present invention.

The present invention relates to antennas and, more particularly, to highly isolated, circular, polarized smart antennas featuring complementary cross recessed corners patches. The present invention is primarily directed to applications of smart antennas featuring simultaneously transmitting antennas and receiving antennas, however, the present invention can clearly be directed to applications of multiple, independent, closely mounted antennas, in a variety of fields such as wireless network, cellular, security, military, surveillance and medical applications.

A general aspect of both the novelty and inventiveness of the present invention is the ability to provide a low-cost, durable and compact antenna array featuring simultaneously transmitting antennas and receiving antennas that use the same frequencies or adjacent frequencies that may interfere with one another.

Another aspect of novelty and inventiveness of the present invention is the efficient use of the installation area as due to the compactness of the antenna array of the present invention.

In contrast with the present invention, prior art solutions use a longer distance between the antennas or use widely spaced frequencies that do not interfere with one another. For example, in an 802.11 g system, prior art adjacent antennas use channels 1 and 11 that do not interfere with one another. By using the antenna of the present invention, it is possible to use the three non-overlapping channels 1, 6, and 11. Channels

1, 6 and 11 represent signals with tails that interfere with one another and therefore require an antenna system that features a high degree of isolation.

Another unique aspect of novelty and inventiveness of the present invention relating to a high degree of antenna isolation that reduces the effect of interference from surrounding devices. This is especially important when the antenna array simultaneously features transmitting antennas and receiving antennas.

Another particular aspect of novelty and inventiveness of the present invention relating to the high degree of mutual coupling between the radiating elements. As a result, an almost zero NULL can be achieved in transmission and reception. The depth of the NULL is related to the size of the antenna's isolation. The better the antenna's isolation, the deeper the achieved NULL. A person skilled in the art should be able, mathematically, to prove that if the mutual coupling is less than 20-25 dB, it is impossible to achieve a deep NULL. In an exemplary embodiment of the present invention, the number of elements in an array antenna is 'N'. The number 'N' determines the number of possible NULLs, which is N−1. The depth of the NULL is determined by an exact calculation in the DSP, along with mutual coupling between elements of the antenna. For example, an array antenna made of four elements makes it possible to achieve three NULLs.

Another particular aspect of novelty and inventiveness of the present invention relating to the low sensitivity to the shape of a Radome covering it. The low sensitivity to the shape of the covering Radome is due to the fact that the reflections from the Radome usually arrive in cross-polarization. As disclosed in the present invention, the antenna of the present invention features improved cross-polarization and therefore is less sensitive to Radome reflections, which usually are cross-polarized.

The present invention is primarily directed to interference cancellation but is useful to noise cancellation too. According to the present invention, noise refers to general signals, while interference refers to specific signals.

The present invention is a highly isolated, circular, polarized smart antenna featuring recessed corner patches. The preferred embodiments of the present invention are discussed in detail below. It is to be understood that the present invention is not limited in its application to the details of construction, arrangement, and, composition of the components of the device set forth in the following description, drawings, or examples. While specific steps, configurations and arrangements are discussed, it is to be understood that this is done for illustrative purposes only. A person skilled in the relevant art will recognize that other steps, configurations and arrangements can be used without departing from the spirit and scope of the present invention.

Moreover, the device of the present invention can be implemented in a variety of configurations. The variety of configurations derived, for example, from the parameters to be optimized.

It is to be understood that the present invention is not limited in its application to the details of construction, arrangement, and, composition of the device set forth in the following description, drawings, or examples. The present invention is capable of other embodiments or of being practiced or carried out in various ways. Also, it is to be understood that the phraseology, terminology, and, notation, employed herein are for the purpose of description and should not be regarded as limiting.

Construction, arrangement, and, composition of the device, according to the present invention are better understood with reference to the following description and accompanying drawings. Throughout the following description and accompanying drawings, like reference numbers refer to like elements. Immediately following are detailed description and illustration of a preferred embodiment of the structure and functions of the device.

The antenna of the present invention features a pair of radiating elements. Each pair of radiating element is fed from the same input. Moreover, the antenna of the present invention is a stacked antenna where each radiating element is made of feeding patch and radiating patch. All radiating patches and their feeding patches are square.

The antenna of the present invention features circular polarization. The circular polarization is achieved by using radiating element featuring recessed corners, as known in the art.

According to the preferred embodiment of the present invention, the corners of a radiating patch and the corners of its feeding patch are cut in opposite directions. In other words, the cross recessed corners of the radiating element are the complement cross corners of the feeding element.

In the description of the present invention, a recessed corner is the same as a square with at least one cut corner.

The use of recessed corner feeding patches result in improved cross-polarization. Improved cross-polarization leads to better isolation between radiating elements of an array antenna and to an antenna featuring improved isolation from its surroundings. For example, the improved cross-polarization may increase the antenna's isolation between two adjacent channels from 30 dB to 50 dB.

The characteristics of the antenna of the present invention can be controlled by setting different values and combinations to the following parameters:

a) The size of the cross-recessed corners.

b) The distance between the two radiating elements fed from the same input.

c) The distance between the radiating patch and the feeding patch.

d) Thickness and type of the dielectric material located between the radiating element and the patch.

An axial ratio measures the distortion of the circular polarization. An ideal circular polarized antenna feature an axial ratio having a value of one that indicates that the circular polarization is circular and not elliptical. In accordance with the present invention, there is using two antenna elements connected to the same input for achieving a better axial ratio. By choosing the proper distance between the radiating elements, a low axial ratio, maintained over the whole operating bandwidth, is obtained.

The distance between the radiating patch and the feeding patch affects the obtained bandwidth of the antenna. The larger the distance between the radiating patch and the feeding patch, the better the bandwidth. On the other hand, the larger the distance between the radiating patch and the feeding patch, the circular polarization clearness is decreased. It is to be understood that the optimal thickness depends on the required antenna characteristics and on its operating frequencies.

The distance between the radiating patch and the feeding patch may be achieved by known in the art methods. An exemplary method uses a dielectric form, known also as "stacking". The distance between the radiating patch and the feeding patch may be determined by known in the art optimization methods The cross recessed corners increase the cross polarization rejection. As the cross-polarization rejection is higher, a better filtration of the opposite polarization is achieved. For example, by using cross-recessed corners, the cross polarization while operating in 2.4 GHz may be better than 30 dB.

After introducing the novel elements of the present invention and their placements, it is to be understood that a person skilled in the art of antenna design is able to determine the appropriate sizes, distances and thickness for a required performance.

It is to be noted that the antenna of the present invention, featured components, and different positions of movement or flexibility thereof, as illustrated in the figures of the present invention, are representative of the highly isolated circular polarized antennas featuring recessed corner patches of the present invention. Specific parts and their numbers may be of variable configuration.

In the following description of the method of the present invention, included are only main or principal steps needed for sufficiently understanding proper 'enabling' utilization and implementation of the disclosed highly isolated circular polarized antennas. Accordingly, descriptions of the various required or optional minor, intermediate, and/or, sub steps, which are readily known by one of ordinary skill in the art, and/or, which are available in the prior art and technical literature relating to antennas design, are not included herein.

Referring now to the drawings, as illustrated in FIG. 1, in an exemplary embodiment of the present invention, additional isolation is gained by applying shifted-polarization to two antennas. The antennas are connected to the same input. As the polarization becomes clearer, the cross-polarization isolation effect between two radiating elements connected to the same input is increased.

Figure 4:
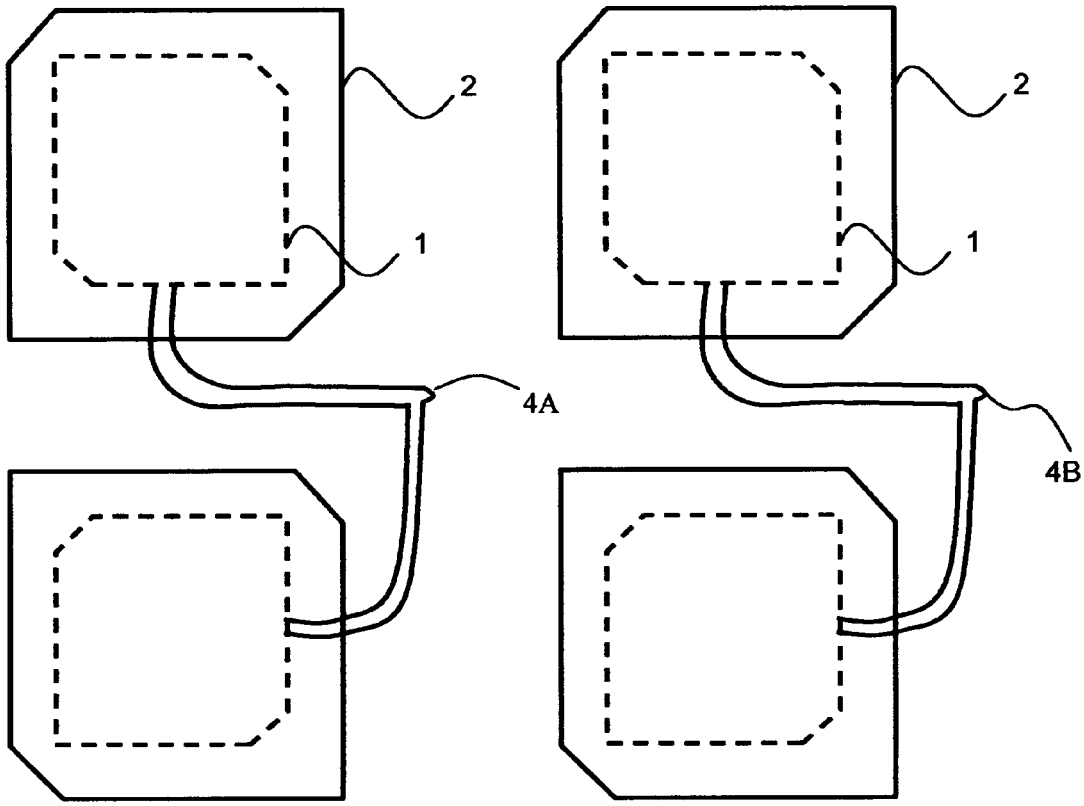
FIG. 4 is an illustration of a preferred embodiment of the circular polarized patch array antenna recessed corner, in accordance with the present invention.

Referring to FIG. 4, in order to clear the polarization, a circular polarized patch antenna with recessed corners is used.

Figure 2:
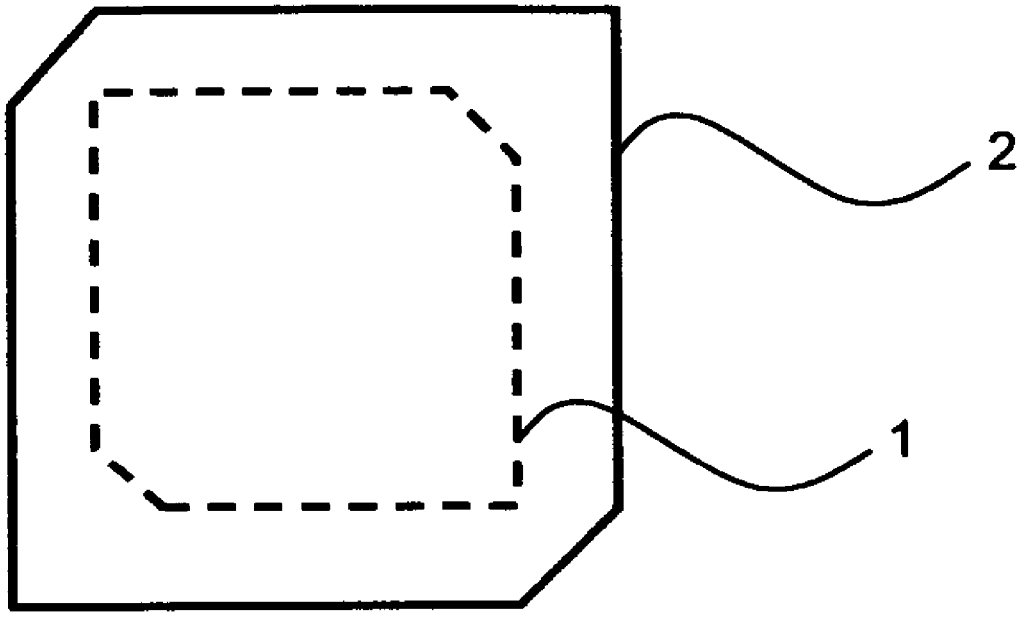
FIG. 2 is an illustration of a preferred embodiment of the circular polarized patch antenna recessed corner, in accordance with the present invention.

Referring to FIG. 2, adding the recessed corner feeding patch further increases the degree of antenna isolation. For example, the degree of antenna isolation may be increased by 5 to 15 dB.

Prior art disclose cross-recessed corner antennas. However, prior art cross-recessed corner antennas are disclosed without a recessed corner patch. Adding the recessed corner patch further increases the isolation. This is because the recessed corner patch cleans the circular polarization.

The corner incision of the radiating patch is in opposite direction to the incision of the feeding patch.

Referring again to FIG. 2, radiating element 2 features cross recessed corners. Feeding patch 1 features complementary cross recessed corners. The dimensions of the cut of each corner affect the cross polarization and axial ratio. The selection of which cross corners to cut sets the direction of the polarization. The dimensions of the cut are a tradeoff between proper axial ratio and cross polarization. In an exemplary embodiment of the present invention, the actual dimensions of each cut and the crossed corners to be cut are obtained by using an optimization process.

Figure 3:
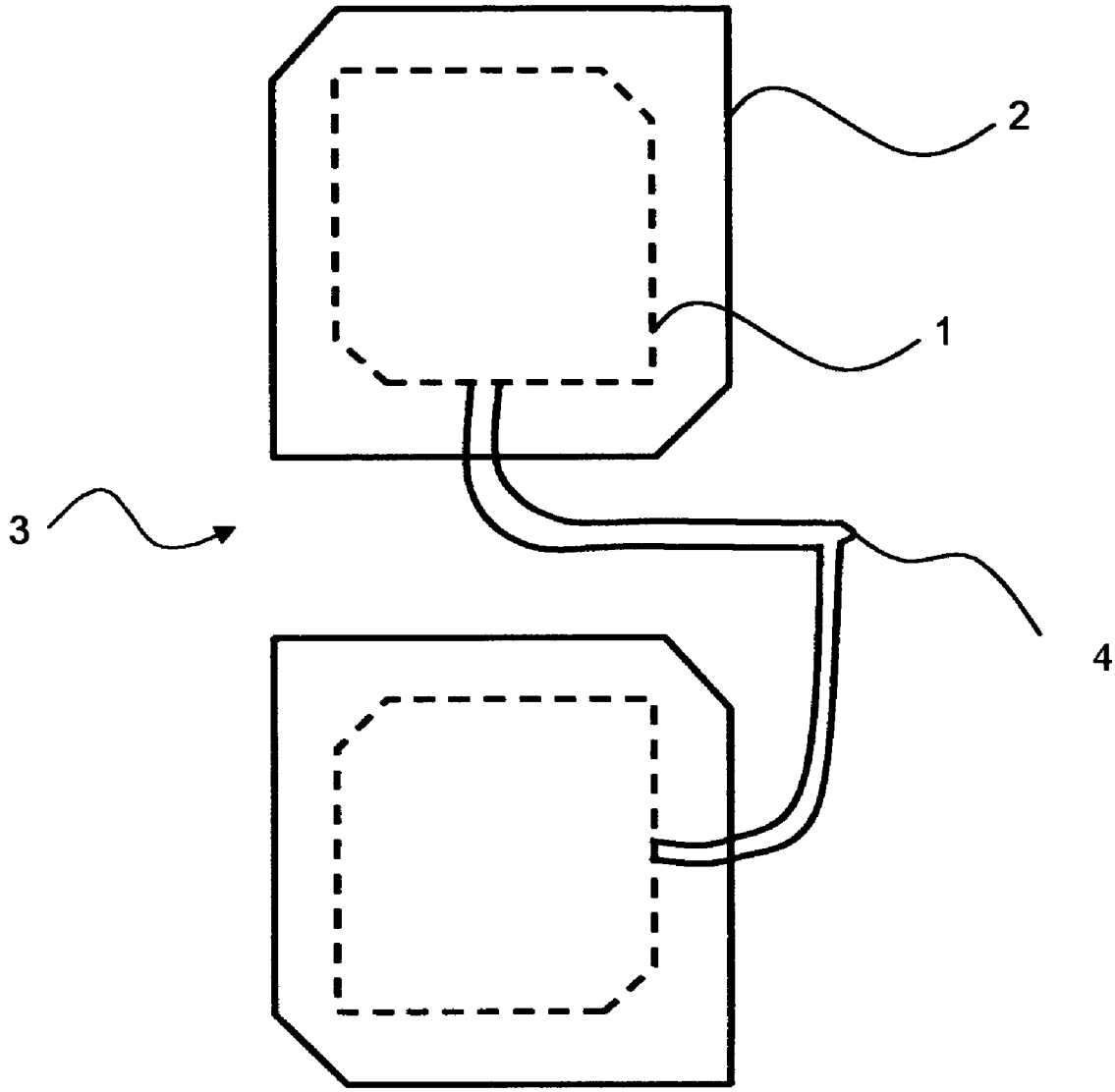
FIG. 3 is an illustration of a preferred embodiment of the circular polarized patch antenna recessed corner connected pair, in accordance with the present invention.

Referring to FIG. 3, every pair of connected antennas is cut in the opposite direction. The two connected antennas are fed from the same input 4. In other words, the two connected antennas are polarization shifted.

In an exemplary embodiment of the present invention, only one pair of antennas is implemented, resulting in a circular polarized antenna having a high level of isolation.

According to another embodiment of the present invention, an array of antennas is implemented. Due to the fact that each antenna is made as illustrated in FIG. 3, the antennas in the array less interfere one another and therefore can be placed closer to one another. In an exemplary embodiment of the present invention, the various antennas in the array are independent on one another. According to another exemplary embodiment of the present invention, the various antennas in the array are dependent on one another.

FIG. 4 illustrates an antenna array. Referring to FIG. 4, in an exemplary preferred embodiment of the present invention, all antennas in the same row feature recessed corners in the same direction.

Figure 5:
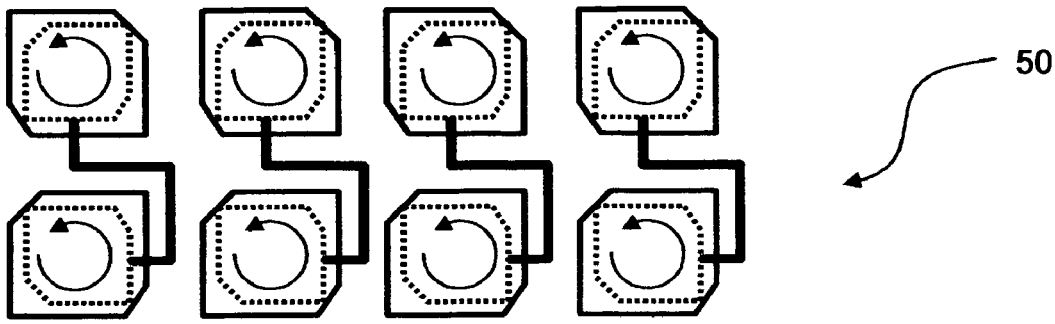
FIG. 5 is an illustration of a preferred embodiment of the smart antenna, in accordance with the present invention.

FIG. 5 illustrate the circular polarization directions according to an exemplary preferred embodiment of the present invention wherein all antennas in the same row feature recessed corners in the same direction.

In another preferred embodiment of the present invention, adjacent antennas in the same row feature recessed corners in the opposite direction, resulting in phase reversal between the radiating elements.

Moreover, when using modulations such as OFDM, the tails of a signal interfere with the adjacent signals. Therefore, the additional isolation achieved by the antenna of the present invention is required for reducing the effects of the aforementioned interference.

Figure 6:
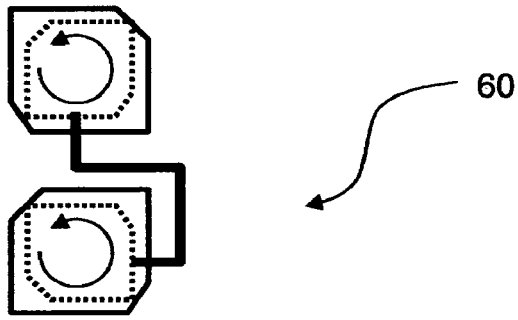
FIG. 6 is an illustration of an additional feeding connection, in accordance with the present invention.

FIG. 6 illustrate additional exemplary possible feeding connection. It is to be understood that there are additional possible feeding connections according to the novel description of the present invention. For example, two shifted antennas connected to the same input where the feeding is shifted in the same direction and there is about a quarter wavelength difference between length of the waveguides.

In an exemplary embodiment of the present invention, the system of the present invention communicates in two different frequencies. Optionally, each frequency has its own antenna. For example, in an 802.11 type of system, 802.11b and 802.11g transmissions may use the same antenna, because they feature the same frequency, but 802.11a transmissions should use a different antenna.

As known in the art, adding additional stacks can improve the usable bandwidth of the antenna. Moreover, different dielectric materials possibly featuring different thicknesses may be use. According to the present invention, further improvement of cross polarization bandwidth of a stack antenna featuring at least two patches is achieved by using cross-recessed corner patches that are arranged is such a way that every two following patches are cut in the opposite corners.

As previously indicated, there are optional additions to the novel antenna of the present invention. In an exemplary embodiment of the present invention, to filter interfering signals in a known frequency band, such as in cellular devices, an analog band-pass filter, as known in the art, is placed on the input to the antenna of the present invention. This novel combination results in a low-cost antenna featuring high antenna isolation and insensitivity to the predefined known frequency band.

When implementing a smart antenna in accordance with the antenna of the present invention, improving the cross polarization improves the isolation between lines of antennas. Moreover, the isolation between elements in the same line is improved. In the specific instance of a smart antenna, isolation between antenna rows is improved. Moreover, isolation between antenna elements in the same row is improved as well.

Antenna arrays in accordance with the present invention feature extra isolation over prior art antennas. For example, this extra isolation may be 20 dB better than prior art antennas. The extra isolation improves cross-polarization as well as improving the coupling between the elements. The improvement of the coupling between the elements leads to better performance by a DSP analyzing the signals received by the antenna. For beam-shaping techniques, such as but not limited to beam-forming and transmit diversity, the lower the mutual coupling, the better the weights at each element are known, which is why it is possible to better calculate the phases and amplitudes.

It is known in the art that when the mutual interference is smaller, it is possible to better sample the signal and to calculate the spatial waveform. As a result, advanced DSP techniques, such as beam forming and transmit diversity, are improved.

According to another preferred embodiment of the present invention, the antenna of the present invention is used with adaptive canceling techniques that are known in the art. According to the adaptive canceling technique, the transmitted signal is measured and this measurement is used for canceling the interference.

According to another preferred embodiment of the present invention, the antenna of the present invention is used with a channel filter.

Thus, it is understood from the embodiments of the invention herein described and illustrated, above, that highly isolated circular polarized antennas, of the present invention, are neither anticipated or obviously derived from the prior art.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination.

It is to be understood that the present invention is not limited in its application to the details of the order or sequence of steps of operation or implementation of the highly isolated, circular, polarized smart antennas featuring recessed corner patches, set in the description, drawings, or examples of the present invention. For example, the novel antenna of the present invention is highly useful for collocation of antennas that need a high degree of isolation. For example, cellular antennas placed in close proximity to one another. Moreover, the novel antenna of the present invention is highly useful for collocation of antennas working in different angles and/or different freq domains, i.e. scaling up or down the frequency. Moreover, the novel antenna of the present invention is highly useful for WIMAX with multi-channel operation and for any base station with antenna collocation.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention.

While the invention has been described in conjunction with specific embodiments and examples thereof, it is to be understood that they have been presented by way of example, and not limitation. Moreover, it is evident that many alternatives, modifications and variations will be apparent to those skilled in the art. Accordingly, it is intended to embrace all such alternatives, modifications and variations that fall within the spirit and broad scope of the appended claims and their equivalents.

What is claimed is:

1. At least one circular polarized antenna comprising:

a feeding patch having cross recessed corners, and a radiating patch having cross recessed corners complementary with the recessed corners of the feeding patch.

2. The at least one circular polarized antenna of claim 1, wherein said at least one circular polarized antenna comprising at least two radiating elements fed from the same input.

3. The circular polarized antenna of claim 2, wherein said at least two radiating elements are polarization shifted.

4. The at least one circular polarized antenna of claim 1, wherein said feeding patch and said radiating patch are sandwiching a dielectric material.

5. The at least one circular polarized antenna of claim 1, wherein said at least one circular polarized antenna features low sensitivity to the shape of a Radome covering it.

6. The at least one circular polarized antenna of claim 1, wherein said at least one circular polarized antenna is an array antenna.

7. A circular polarized stacked array antenna comprising:

feeding patches having cross recessed corners, radiating patches having cross recessed corners, and at least one sandwiched cross-recessed corner patch, wherein the patches are arranged in such a way that every two following stacked patches are cut in the complementary corners.

* * * * *